US006095281A

United States Patent [19]

Jianxing

[11] Patent Number: 6,095,281

[45] Date of Patent: Aug. 1, 2000

[54] LOW NOISE AIR CONDITIONER HOUSING

[75] Inventor: Tao Jianxing, Taizhou, China

[73] Assignee: Jiangsu Chulan Refrigentating, Taizhou, Switzerland

[21] Appl. No.: 09/169,186

[22] Filed: Oct. 8, 1998

[51] Int. Cl.[7] ..... G10K 11/04

[52] U.S. Cl. ..... 181/200; 181/204; 181/224; 181/212; 181/175; 181/198; 181/225; 181/229; 62/262; 62/296; 62/258

[58] Field of Search ..... 62/262, 296, DIG. 13, 62/258; 181/200, 204, 224, 212, 175, 198, 225, 229, 403; D23/351; 249/144, 79, 80, 111

[56] References Cited

U.S. PATENT DOCUMENTS 3,756,039 9/1973 Riello ..... 62/262

4,144,296 3/1979 Dickens ..... 264/45.4

5,373,894 12/1994 Tomatsuri ..... 165/134.1

*Primary Examiner*—Stanley J. Witkowski

*Assistant Examiner*—E. San Martin

*Attorney, Agent, or Firm*—Abelman, Frayne & Schwab

[57] ABSTRACT

A window-type air conditioner housing includes a backboard and two parietal sideboards of polystyrene. Each sideboard has a steel plate implant and a coaxial bracing hole for supporting a motor and an associated air conditioner fan bearing components, respectively, to thereby maintain vibration and noise at reduced levels. Preferably each steel plate implant is dimpled in the area surrounding each coaxial bracing hole to strengthen and stiffen the sideboard in that area for supporting the motor and fan assembly.

40 Claims, 2 Drawing Sheets

LOW NOISE AIR CONDITIONER HOUSING

BACKGROUND OF THE INVENTION

1. Field of the Invention

The present application relates to a low noise and vibration air conditioner housing for a window-type air conditioner.

2. Description of the Related Art

Window-type air conditioner housing ducts are generally have low strength and are usually used with a centrifugal fan. However, a centrifugal fan has low-power and produces loud-noises. At the same time, the motor must be installed on a special device mounted on the chassis of the air conditioner. Such special device can cause the air conditioner to produce intensive vibration and loud noises. I have invented a window-type air conditioning air conditioner housing which overcomes the problems of the prior art and thereby maintains noise and vibration at substantially low levels.

BRIEF SUMMARY OF THE INVENTION

A window-type air conditioner housing duct (hereinafter "the unit") which comprises a backboard and two parietal sideboards extending therefrom, each sideboard having a steel plate implant and a coaxial bracing hole for supporting a motor and associated air conditioner fan bearing components. Vibration and noise are kept to reduced levels. The entire unit is formed of a moldable material, such as polystyrene. The sideboards also are adapted to support a coaxial crosscurrent air conditioner fan.

In a preferred embodiment the unit consists of a backboard and two parietal sideboards which are parallel to each other and are perpendicular to the backboard. Small distributive holes are made through the steel plate implants of the sideboards and there are two coaxial bracing holes in the two parietal sideboards. The small distributive holes in the steel plate implants enable the polystyrene materials on the two sides of the steel plate to meet and thereby strengthen the sideboards.

Because the steel plate implants of the unit strengthen the sideboards substantially, the motor and the bearing components of the associated driven fan can be mounted on the two coaxial bracing holes of the sideboards. It can accommodate installation of a high-powered and low noise crosscurrent fan. The bracing holes are formed and the inserts are strengthened and stiffened in the area surrounding the holes by dimpling the steel plate implants, preferably by a swaging process. Other known strengthening techniques are contemplated.

The entire unit is integrally molded and produced as a single piece unit. Coaxial alignment of the two bracing holes on the two sideboards is thus ensured. This solves the technical difficulty of maintaining coaxial alignment of the crosscurrent fan successfully. At the same time, it simplifies motor installation and results in maintaining a low-grade—or low level—vibration and a low degree of noise. The present invention is particularly useful for incorporation into the air conditioner described in commonly assigned, concurrently filed U.S. patent application Ser. No. 09/169,187, entitled Low Noise Window-Type Air Conditioner, the disclosure of which is incorporated herein by reference and made a part of this disclosure.

DETAILED DESCRIPTION OF THE INVENTION

Figure 1:
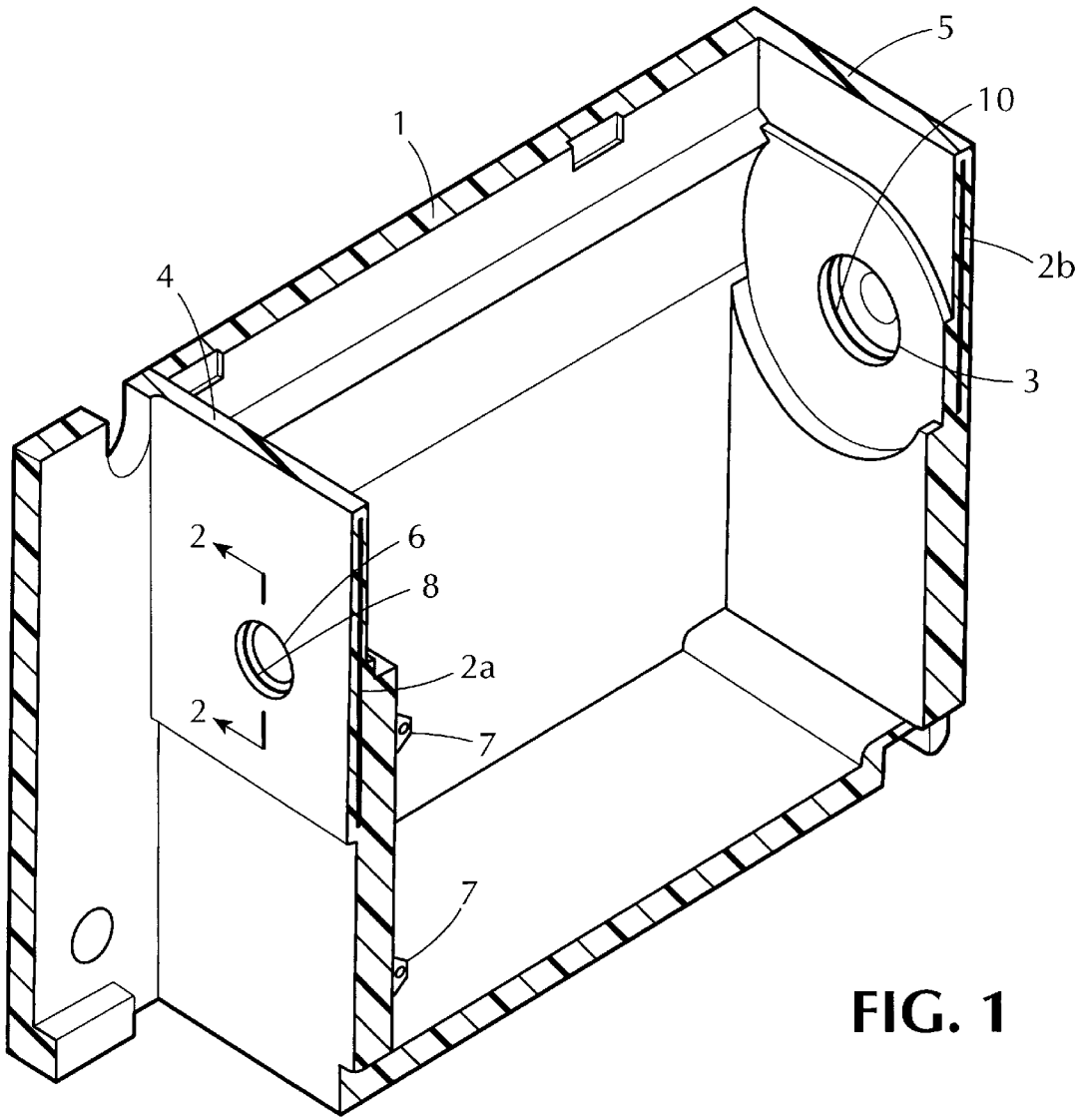
FIG. 1 is a perspective view of an low noise air conditioner housing constructed according to the present invention.

Referring to FIG. 1 there is illustrated a perspective view of a preferred embodiment of a window-type air conditioner housing constructed according to the present invention. The housing consists of a backboard 1 and two parietal polystyrene sideboards 4, 5 which are parallel to each other and are perpendicular to the backboard 1 as shown.

Each polystyrene sideboard 4, 5 includes a steel plate implant 2 having coaxial bracing holes 3, 6 in the parietal board walls. In the embodiment shown, there are outward pillars formed preferably by dimpling or swaging as shown in the area surrounding the bracing holes 8, 10 of the steel implants 2*a*, 2*b* which can be used to install a fan motor and related bearing components. Alternative strengthening techniques in the area surrounding the bracing holes, well known to those persons of ordinary skill in the art, are within the scope of the invention, and may be utilized.

Referring again to FIG. 1, brackets 7 having fixed holes are provided for installing other parts. The present invention is advantageous for use with window-type air conditioners, particularly as described in the aforementioned commonly assigned, concurrently filed application entitled Low Noise Window-Type Air Conditioner in that it:

1) reduces vibrations;
2) reduces the passage of noise from the outdoor part;
3) provides significant support for the fan and the fan driving motor; and
4) provides heat insulation;
5) ensures coaxial alignment of the crosscurrent fan; and
6) provides a low degree of noise In particular, the polystyrene parts provide noise, vibration and heat transfer reduction, while the steel implants provide strength and stiffness, while assisting in maintaining reduction of noise and vibration.

Figure 2C:
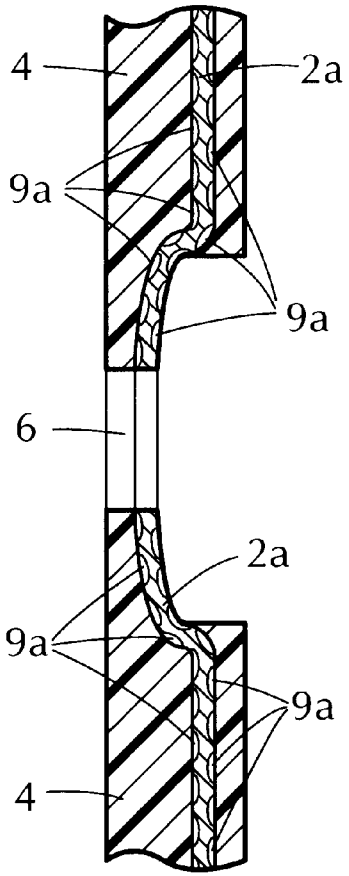
FIG. 2 is cross-sectional view taken along lines 2—2 of FIG. 1, illustrating the dimpled configuration of the steel implants at the coaxial bracing holes.
Figure 2B:
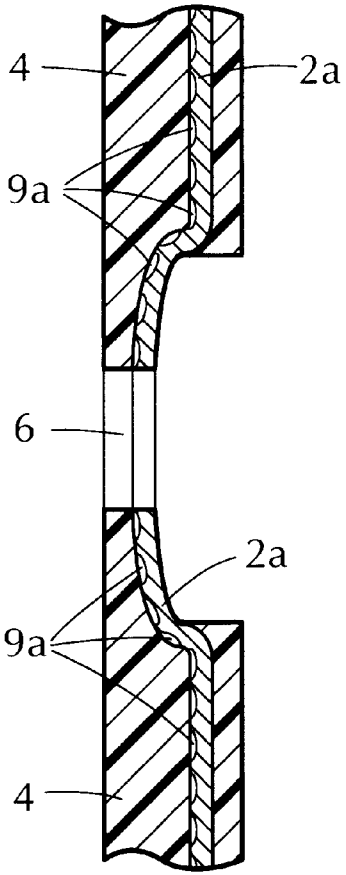
Figure 2A:
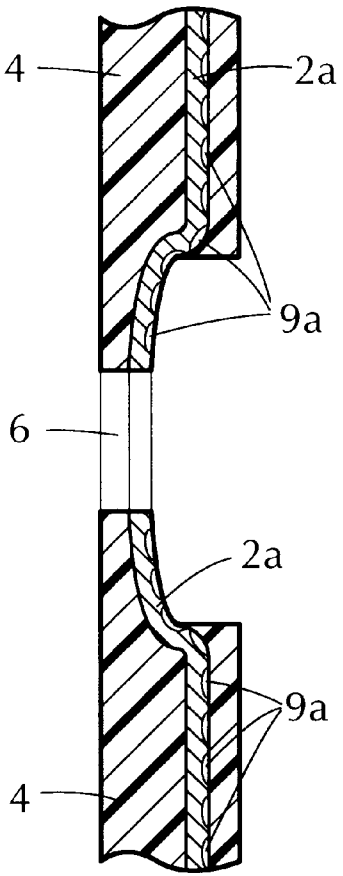

Referring now to FIG. 2, there is shown a cross-sectional view taken along lines 2—2 of FIG. 1. As can be seen in FIG. 2, the steel plate implant 2 is dimpled as shown at 2' in the area surrounding the bracing hole 6, preferably by a swaging process, while forming the duct. This dimpled portion ensures coaxial alignment of the crosscurrent fan successfully. At the same time it simplifies the machinery used to install the motor and provides stiffness to the unit, which in turn, reduces the vibration and noise produced by the fan. Although not shown in the drawing, the steel plate implant in the opposite sideboard is also dimpled in a direction opposite the dimple shown in the left sideboard of FIG. 1. Alternative types of dimpling and strengthening techniques, well known to those persons of ordinary skill in the art, are within the scope of this invention, and may be utilized. Also, the dimples can be made to extend in different directions or in the opposite direction from that shown. In addition, the steel plate implants may be alternatively shaped to provide stiffening in the area surrounding the bracing holes.

Although the invention has been described in detail with reference to the illustrated preferred embodiments, variations and modifications may be provided within the scope and spirit of the invention as described and as defined by the following claims.

What is claimed is:

1. An air conditioner housing, for a window-mountable air conditioner, comprising:

a. a backboard (1);

b. first and second sideboards (4, 5), spaced apart from and parallel to one another, and perpendicular to the backboard (1), such that the sideboards (4, 5) extend from the backboard (1) in the same direction therefrom, with the first sideboard (4) having a first bracing hole (6) therein, and the second sideboard (5) having a second bracing hole (3) therein, such that the bracing holes (3, 6) are coaxially aligned with one another, and are utilizable for supporting an air conditioner fan, an air conditioner fan motor, and associated bearing components therefor; and c. first and second steel plates (2*a,* 2*b*), for providing strength and stiffness to the air conditioner housing so that vibration and noise levels are reduced, such that the first steel plate (2*a*) is implanted in the first sideboard (4), and the second steel plate (2*b*) is implanted in the second sideboard (5).

2. The air conditioner housing according to claim 1, wherein the first and second sideboards (4, 5) are formed of polystyrene.

3. The air conditioner housing according to claim 1, wherein the first steel plate (2*a*) surrounds first bracing hole (6) in first sideboard (4), and the second steel plate (2*b*) surrounds second bracing hole (3) in second sideboard (5).

4. The air conditioner housing according to claim 1, wherein a plurality of bracket members (7), having holes therein, are further provided, such that the bracket members (7) are mounted on at least one of the sideboards (4, 5), and are utilized to attach and support further components of an air conditioner.

5. The air conditioner housing according to claim 1, wherein the air conditioner fan supported by the first and second sideboards (4, 5) is a crosscurrent fan.

6. The air conditioner housing according to claim 1, wherein the first and second steel plates (2*a,* 2*b*) each have a corresponding dimpled portion (9*a,* 9*b*) thereof, in an area near the bracing holes (3,6) in the corresponding sideboard (4, 5) in which the respective steel plate (2*a,* 2*b*) is implanted.

7. The air conditioner housing according to claim 6, wherein the dimpled portion of the steel plates (2*a,* 2*b*) is formed by swaging the steel plates (2*a,* 2*b*) in an area where the dimpled portion is desired to be formed.

8. The air conditioner housing according to claim 6, wherein the dimpled portion of the steel plates (2*a,* 2*b*) is present on each steel plate on a side thereof which faces in an outwardly axial direction toward an exterior of the air conditioner housing.

9. The air conditioner housing according to claim 6, wherein the dimpled portion of the steel plates (2*a,* 2*b*) is present on each steel plate on a side thereof which faces in an inwardly axial direction toward an interior of the air conditioner housing.

10. The air conditioner housing according to claim 6, wherein the dimpled portion of the steel plates (2*a,* 2*b*) is present on each steel plate both on a side thereof which faces in an outwardly axial direction toward an exterior of the air conditioner housing, and on a side thereof which faces in an inwardly axial direction toward an interior of the air conditioner housing.

11. The air conditioner housing according to claim 1, wherein the backboard (1) and the sideboards (4, 5) are formed from a moldable material.

12. The air conditioner housing according to claim 11, wherein the moldable material is polystyrene.

13. The air conditioner housing according to claim 11, wherein the backboard (1) and the sideboards (4, 5) are integrally molded as a single piece unit.

14. The air conditioner housing according to claim 11, wherein the backboard (1) and the sideboards (4, 5) are integrally molded as a single piece unit made of polystryene.

15. The air conditioner housing according to claim 11, wherein steel plates (2*a,* 2*b*) contain a plurality of holes therein, such that when the sideboards (4, 5) are molded with the respective steel plates (2*a,* 2*b*) implanted therein, moldable material from which the sideboards (4, 5) are formed flows into and through the plurality of holes to further strengthen the resulting sideboards (4, 5).

16. An air conditioner housing, for a window-mountable air conditioner, comprising:

a. a backboard (1);

b. first and second sideboards (4, 5), spaced apart from and parallel to one another, and perpendicular to the backboard (1), such that the sideboards (4, 5) extend from the backboard (1) in the same direction therefrom, with the first sideboard (4) having a first bracing hole (6) therein, and the second sideboard (5) having a second bracing hole (3) therein, such that the bracing holes (3, 6) are coaxially aligned with one another, and are utilizable for supporting an air conditioner fan, an air conditioner fan motor, and associated bearing components therefor; and c. first and second steel plates (2*a,* 2*b*), for providing strength and stiffness to the air conditioner housing so that vibration and noise levels are reduced, such that first steel plate (2*a*) is implanted in the first sideboard (4), and the second steel plate (2*b*) is implanted in the second sideboard (5), with the first steel plate (2*a*) having a bracing hole (8) therein, and the second steel plate (2*b*) having a bracing hole (10) therein, such that the bracing hole (8) in the first steel plate (2*a*) is coaxially aligned with the bracing hole (6) in the first side board (4), and the bracing hole (10) in the second steel plate (2*b*) is coaxially aligned with the bracing hole (3) in the second side board (5), and further such that the bracing holes (8, 10) of the first and second steel plates (2*a,* 2*b*), respectively, are coaxially aligned with one another, with each steel plate (2*a,* 2*b*) further having a dimpled portion thereof that surrounds the bracing hole (3, 6) in the corresponding sideboard (4, 5) in which the respective steel plate (2*a,* 2*b*) is implanted.

17. The air conditioner housing according to claim 16, wherein the dimpled portion of the steel plates (2*a,* 2*b*) is formed by swaging the steel plates (2*a,* 2*b*) in an area where the dimpled portion is desired to be formed.

18. The air conditioner housing according to claim 16, wherein the dimpled portion of the steel plates (2*a,* 2*b*) is present on each steel plate on a side thereof which faces in an outwardly axial direction toward an exterior of the air conditioner housing.

19. The air conditioner housing according to claim 16, wherein the dimpled portion of the steel plates (2*a,* 2*b*) is present on each steel plate on a side thereof which faces in an inwardly axial direction toward an interior of the air conditioner housing.

20. The air conditioner housing according to claim 16, wherein the dimpled portion of the steel plates (2*a,* 2*b*) is present on each steel plate both on a side thereof which faces in an outwardly axial direction toward an exterior of the air conditioner housing, and on a side thereof which faces in an inwardly axial direction toward an interior of the air conditioner housing.

21. The air conditioner housing according to claim 16, wherein the first and second sideboards (4, 5) are formed of polystyrene.

22. The air conditioner housing according to claim 16, wherein a plurality of bracket members (7), having holes therein, are further provided, such that the bracket members (7) are mounted on at least one of the sideboards (4, 5), and are utilized to attach and support further components of an air conditioner.

23. The air conditioner housing according to claim 16, wherein the air conditioner fan supported by the first and second sideboards (4, 5) is a crosscurrent fan.

24. The air conditioner housing according to claim 16, wherein the backboard (1) and the sideboards (4, 5) are formed from a moldable material.

25. The air conditioner housing according to claim 24, wherein the moldable material is polystyrene.

26. The air conditioner housing according to claim 24, wherein the backboard (1) and the sideboards (4, 5) are integrally molded as a single piece unit.

27. The air conditioner housing according to claim 24, wherein the backboard (1) and the sideboards (4, 5) are integrally molded as a single piece unit made of polystryene.

28. The air conditioner housing according to claim 24, wherein steel plates **(2*a*, 2*b*) contain a plurality of holes therein, such that when the sideboards (4, 5) are molded with the respective steel plates (2*a*, 2*b*) implanted therein, moldable material from which the sideboards (4, 5) are formed flows into and through the plurality of holes to further strengthen the resulting sideboards (4, 5)**.

29. An air conditioner housing, for a window-mountable air conditioner, comprising:

a. a backboard (1);

b. first and second sideboards (4, 5), formed of polystyrene, spaced apart from and parallel to one another, and perpendicular to the backboard (1), such that the sideboards (4, 5) extend from the backboard (1) in the same direction therefrom, with the first sideboard (4) having a first bracing hole (6) therein, and the second sideboard (5) having a second bracing hole (3) therein, such that the bracing holes (3, 6) are coaxially aligned with one another, and are utilizable for supporting an air conditioner fan, an air conditioner fan motor, and associated bearing components therefor; and c. first and second steel plates **(2*a*, 2*b*), for providing strength and stiffness to the air conditioner housing so that vibration and noise levels are reduced, such that first steel plate (2*a*) is implanted in the first sideboard (4), and the second steel plate (2*b*) is implanted in the second sideboard (5), with each steel plate (2*a*, 2*b*) further having a dimpled portion thereof that surrounds the bracing hole (3, 6) in the corresponding sideboard (4, 5) in which the respective steel plate (2*a*, 2*b*)** is implanted.

30. The air conditioner housing according to claim 29, wherein a plurality of bracket members (7), having holes therein, are further provided, such that the bracket members (7) are mounted on at least one of the sideboards (4, 5), and are utilized to attach and support further components of an air conditioner.

31. The air conditioner housing according to claim 29, wherein the air conditioner fan supported by the first and second sideboards (4, 5) is a crosscurrent fan.

32. The air conditioner housing according to claim 29, wherein the dimpled portion of the steel plates **(2*a*, 2*b*) is formed by swaging the steel plates (2*a*, 2*b*)** in an area where the dimpled portion is desired to be formed.

33. The air conditioner housing according to claim 29, wherein the dimpled portion of the steel plates **(2*a*, 2*b*)** is present on each steel plate on a side thereof which faces in an outwardly axial direction toward an exterior of the air conditioner housing.

34. The air conditioner housing according to claim 29, wherein the dimpled portion of the steel plates **(2*a*, 2*b*)** is present on each steel plate on a side thereof which faces in an inwardly axial direction toward an interior of the air conditioner housing.

35. The air conditioner housing according to claim 29, wherein the dimpled portion of the steel plates **(2*a*, 2*b*)** is present on each steel plate both on a side thereof which faces in an outwardly axial direction toward an exterior of the air conditioner housing, and on a side thereof which faces in an inwardly axial direction toward an interior of the air conditioner housing.

36. The air conditioner housing according to claim 29, wherein the backboard (1) is formed from a moldable material.

37. The air conditioner housing according to claim 36, wherein the moldable material is polystyrene.

38. The air conditioner housing according to claim 36, wherein the backboard (1) and the sideboards (4, 5) are integrally molded as a single piece unit.

39. The air conditioner housing according to claim 36, wherein the backboard (1) and the sideboards (4, 5) are integrally molded as a single piece unit made of polystryene.

40. The air conditioner housing according to claim 36, wherein steel plates **(2*a*, 2*b*) contain a plurality of holes therein, such that when the sideboards (4, 5) are molded with the respective steel plates (2*a*, 2*b*) implanted therein, moldable material from which the sideboards (4, 5) are formed flows into and through the plurality of holes to further strengthen the resulting sideboards (4, 5)**.

* * * * *

UNITED STATES PATENT AND TRADEMARK OFFICE

CERTIFICATE OF CORRECTION

PATENT NO. : 6,095,281
DATED : August 1, 2000
INVENTOR(S) : Tao Jianxing

It is certified that error appears in the above-identified patent and that said Letters Patent is hereby corrected as shown below:

Title page,
[73] Assignee: "Jiangsu Chulan Refrigentating, Taizhou, Switzerland" should read -- Chunlan (Group) Corporation Taizhou, The People's Republic of China --.

Signed and Sealed this

Thirtieth Day of October, 2001

*Attest:*

Nicholas P. Godici

*Attesting Officer*

NICHOLAS P. GODICI
*Acting Director of the United States Patent and Trademark Office*